US010419154B2

(12) United States Patent
Bergeron et al.

(10) Patent No.: US 10,419,154 B2
(45) Date of Patent: Sep. 17, 2019

(54) SYSTEMS AND METHODS FOR ENCRYPTING OPTICAL SIGNALS

(71) Applicant: Raytheon Company, Waltham, MA (US)

(72) Inventors: John M. Bergeron, Northfield, NH (US); Andrew D. W. McKie, Northborough, MA (US); Carl E. Buczala, Rowley, MA (US)

(73) Assignee: Raytheon Company, Waltham, MA (US)

( * ) Notice: Subject to any disclaimer, the term of this patent is extended or adjusted under 35 U.S.C. 154(b) by 126 days.

(21) Appl. No.: 15/186,935

(22) Filed: Jun. 20, 2016

(65) Prior Publication Data

US 2017/0366293 A1 Dec. 21, 2017

(51) Int. Cl.
*H04K 1/00* (2006.01)

(52) U.S. Cl.
CPC ..... *H04K 1/00* (2013.01); *H04K 1/006* (2013.01)

(58) Field of Classification Search
CPC ..... H04K 1/006
USPC ..... 380/256
See application file for complete search history.

(56) References Cited

U.S. PATENT DOCUMENTS 5,373,151 A 12/1994 Eckel, Jr. et al.
5,793,871 A 8/1998 Jackson
6,002,773 A 12/1999 Javidi
6,708,003 B1 3/2004 Wickham et al.
7,236,595 B1 6/2007 Bean et al.
7,720,226 B2 * 5/2010 Turpin ..... H04K 1/04 359/577
8,428,259 B2 4/2013 Waters
2002/0024736 A1 * 2/2002 Itou ..... G02B 5/20 359/578

(Continued)

FOREIGN PATENT DOCUMENTS

CN 104159073 A 11/2014
EP 1093689 A1 4/2001

OTHER PUBLICATIONS

Alfalou, et al.; "Optical Image Compression and Encryption Methods;" HAL Archives-Ouvertes; Sep. 13, 2010; pp. 589-636 (49 pages).

(Continued)

*Primary Examiner* — Khalil Naghdali
(74) *Attorney, Agent, or Firm* — Daly, Crowley Mofford & Durkee, LLP

(57) ABSTRACT

The concepts, systems and methods described herein are directed towards encrypting optical signals prior to the optical signals being sensed, for example, by a sensor. An optical phased array (OPA) may be disposed between an optical chain and a sensor to encrypt an optical signal being sensed before the signal is received at the sensor. The method includes receiving an optical signal having a plurality of beams organized in a first arrangement at an optical phased array, encrypting the optical signal in the optical phased array by steering or otherwise phase shifting the plurality of beams from the first arrangement to a second arrangement, transmitting the plurality of beams in the second arrangement from the optical phased array to a sensor and sensing the encrypted optical signal having the plurality of beams in the second arrangement at the sensor.

20 Claims, 7 Drawing Sheets

(56) References Cited

U.S. PATENT DOCUMENTS

| | | | | |
|---|---|---|---|---|
| 2005/0286908 | A1* | 12/2005 | Way | H04B 10/2575 398/186 |
| 2006/0280304 | A1 | 12/2006 | Waters | |
| 2008/0130887 | A1* | 6/2008 | Harvey | H04B 10/85 380/256 |

OTHER PUBLICATIONS

Barrera, et al.; "Experimental QR Code Optical Encryption: Noise-Free Data Recovering;" Optical Society of America, Optical Letters, vol. 39, No. 10; May 15, 2014; pp. 3074-3077 (4 pages).

Hennelly et al.; "Optical Image Encryption by Random Shifting in Fractional Fourier Domains;" Optical Society of America, Optical Letters, vol. 28, No. 4; Feb. 15, 2003; pp. 269-271 (3 pages).

Kumar, et al.; "Optical Image Encryption Using a Jigsaw Transform for Silhouette Removal in Interference-Based Methods and Decryption with a Single Spatial Light Modulator;" Optical Society of America, Optical Letters, vol. 50, No. 13; May 1, 2011; pp. 1805-1811 (7 pages).

Li, et al.; "Compressive Optical Image Encryption;" Scientific Reports, DOI: 10.1038/srep10374; May 20, 2015; pp. 1-10 (10 pages).

Liu, et al.; "Image Encryption Based on Random Scrambling of the Amplitude and Phase in the Frequency Domain;" Research Gate, Optical Engineering, vol. 48(8); Aug. 1, 2009; 7 pages.

Mogensen, et al.; "Phase-Only Optical Encryption;" Optical Society of America, Optical Letters, vol. 25, No. 8; Apr. 15, 2000; pp. 566-568 (3 pages).

Monaghan, et al.; "Systematic Errors of an Optical Encryption System Due to the Discrete Values of a Spatial Light Modulator;" Optical Engineering, vol. 48(2), 027001; Feb. 1, 2009; 7 pages.

Nakano, et al.; "Encrypted Imaging Based on Algebraic Implementation of Double Random Phase Encoding;" Optical Society of America, Applied Optics, vol. 53, No. 14; May 2, 2014; pp. 2956-2962 (8 pages).

Ohtsubo, et al.; "Practical Image Encryption and Decryption by Phase-Coding Technique for Optical Security Systems;" Optical Society of America, Applied Optics, vol. 41, No. 23; Aug. 10, 2002; pp. 4848-4855 (8 pages).

Refregier, Philippe; "Optical Image Encryption Based on Input Plane and Fourier Plane Random Encoding;" Optical Society of America, Optics Letters, vol. 20, No. 7; Apr. 1, 1995; pp. 767-769 (3 pages).

Unnikrishnan, et al.; "Optical Encryption System Using Spatial Light Modulator;" OSJ/SPIE Conference on Optical Engineering for Sensing and Nanotechnology, vol. 3740; Jun. 1, 1999; pp. 525-528 (4 pages).

* cited by examiner

SYSTEMS AND METHODS FOR ENCRYPTING OPTICAL SIGNALS

BACKGROUND

As is known in the art, video sensors are often remotely deployed to sense sensitive information. The recorded information can then be transmitted over a communication network to a command post, or other like manned station that is remote from the video sensor. Thus, there may be vulnerability of compromise in the transport of the recorded information through the communications network. The various components of the communications network (e.g., video sensor, devices at the command post) may be susceptible to hacking before the recorded information can be encrypted. For example, if the compromise involves the physical or electronic hacking of the video sensor itself, the recorded information may be stolen before it can be encrypted.

SUMMARY

The concepts, systems and methods described herein are directed towards encrypting optical signals and/or communications prior to the optical signals and/or communications being sensed, for example, by a sensor. In an embodiment, an optical phased array (OPA) device may be disposed between an optical chain (lenses), and a focal plane array (FPA) of a sensor to scramble (e.g., encrypt) an image being sensed. The OPA may phase shift or steer the rays of light from the image in order to divert the rays into a new arrangement, thus generating a new, encrypted image. In some embodiments, the rays of light sensed at the FPA appear to be scrambled in a random pattern.

The steering of the OPA may be controlled using various types of encryption code generation techniques. The encryption codes may be provided to an OPA directly or a remote device may control the phase shifting and/or beam steering of the OPA based on the encryption codes. The encrypted image may be transmitted over a communications network and received at a command post or other remote station (e.g., remote from the sensor) in a different arrangement than its original form.

The encrypted image can be received at the command post and be decrypted prior to being displayed. The decryption process may return the image to its original form. In some embodiments, the decryption codes used in the decryption process may mirror the encryption codes used by the OPA to encrypt the image. In some embodiments, the decryption process may include another OPA to phase shift the rays of light from the encrypted arrangement back to the original arrangement, thus returning the image to its original form.

The encryption systems and methods described here can be de-coupled from the sensor and therefore may increase the security of an encryption process as the image is encrypted prior to being sensed at the sensor. Thus, in a case in which the sensor is hacked, the hackers may only find the encrypted image and not the original image. In some embodiments, in which the OPA may be physically hacked and the encrypted phase shifting and/or beam steering disabled, the sensor can be disabled and otherwise deemed non-operational in response to the hack.

In one aspect, a method is provided for encrypting optical signals. The method may comprise receiving an optical signal having a plurality of beams organized in a first arrangement at an optical phased array, encrypting the optical signal in the optical phased array by phase shifting (e.g., steering, applying a linear phase ramp) the plurality of beams from the first arrangement to a second arrangement, transmitting the plurality of beams in the second arrangement from the optical phased array to a sensor and sensing the encrypted optical signal having the plurality of beams in the second arrangement at the sensor.

In some embodiments, the optical signal may be a first image. The first image may be divided into a plurality of portions in the first arrangement and the plurality of portions may be steered to the sensor in the second arrangement to generate a second image.

In an embodiment, the method may include dividing the optical signal into a first portion and a second portion and phase shifting the plurality of beams in the first portion to the second portion and phase shifting the plurality of beams in the second portion to the first portion to generate the second arrangement. In some embodiments, a phase shift may be applied applying to one or more of the plurality of beams in the optical signal. For example, a first phase shift may be applied to a first group of beams in the plurality of beams and a second phase shift may be applied to a second group of beams in the plurality of beams.

In an embodiment, the method may include decrypting the optical signal to convert the plurality of beams from the second arrangement to the first arrangement. A phase of one or more of the plurality of beams may be modulated in the second arrangement to optically decrypt the optical signal. In some embodiments, the method may include dividing the optical signal in the second arrangement into a plurality of regions. An offset value may be determined for each of the plurality of regions. The offset value may correspond to a difference of a position of the respective region in the second arrangement compared to the first arrangement. The optical signal may be reconstructed in the first arrangement based on the plurality of regions and the offset value corresponding to each region.

In another aspect, a system is provided for encrypting optical signals. The system may comprise a first lens to receive an optical signal having a plurality of beams organized in a first arrangement and a first optical phased array disposed in an optical path between the first lens and a sensor. The first optical phased array may be configured to encrypt the optical signal by phase shifting and/or steering the plurality of beams from the first arrangement to a second arrangement and transmit the plurality of beams in the second arrangement from the optical phased array to a sensor. The second arrangement may be different than the first arrangement. The system may further comprise the sensor to sense the encrypted optical signal with the plurality of beams organized in the second arrangement.

In an embodiment, a second lens may be disposed in the optical path between the first optical phased array and the sensor. A steering code module may be coupled to the first optical phased array. The steering code module may be configured to provide an encryption code to the first optical phased array to phase shift and/or steer the plurality of beams to the second arrangement.

In an embodiment, the sensor may include a focal plane array to receive the encrypted optical signal from the first optical phased array and an image module to process the encrypted optical signal and transmit the encrypted optical signal. A decryption module may be communicatively coupled to the sensor. The decryption module may be configured to receive the encrypted optical signal from the sensor and convert the plurality of beams from the second arrangement to the first arrangement.

In an embodiment, the decryption module may include a second optical phased array to modulate a phase of one or more of the plurality of beams in the second arrangement to optically decrypt the optical signal. The decryption module may be coupled to a steering code module to receive an encryption code provided to the first optical phased array. In an embodiment, the decryption module may be configured to divide the encrypted optical signal in the second arrangement into a plurality of regions. The decryption module may be configured to determine an offset value for each of the plurality of regions, wherein the offset value corresponds to a difference of a position of the respective region in the second arrangement compared to the first arrangement and reconstruct the optical signal in the first arrangement based on the plurality of regions and the offset value corresponding to each region.

BRIEF DESCRIPTION OF THE DRAWINGS

The foregoing features may be more fully understood from the following description of the drawings in which.

DETAILED DESCRIPTION

Figure 1:
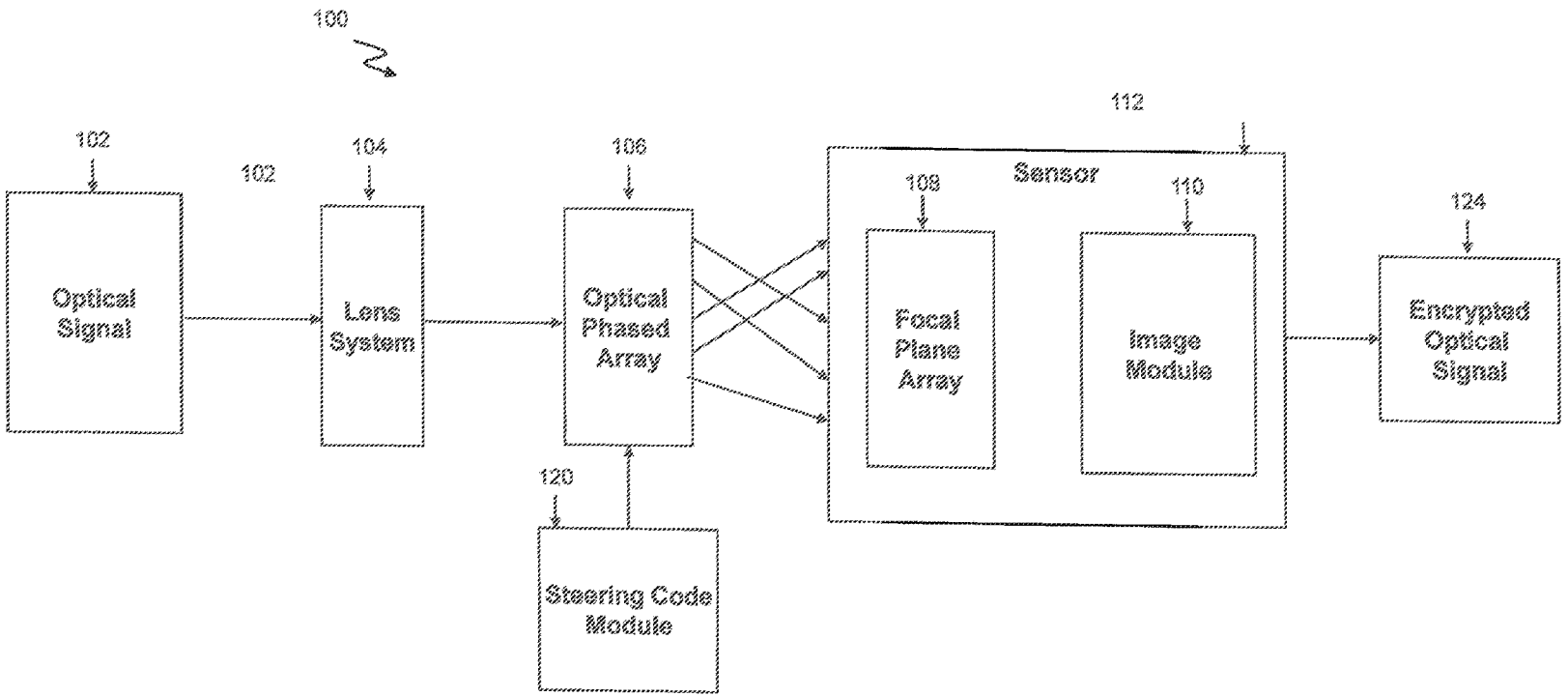
FIG. 1 is a block diagram of a system for encrypting optical signals.

Now referring to FIG. 1, an encryption system 100 includes a lens system 104 (e.g., first lens, second lens), an optical phased array (OPA) 106 and a sensor 112. In an embodiment, the OPA 106 may be physically separated from the sensor 112. For example, an airgap may exist between the OPA 106 and the sensor 112. The dimensions of the airgap may vary based on a particular application of the encryption system 100. Thus, electronics of the sensor 112 may be separated from the OPA 106 to provide additional security in case the sensor 112 is hacked or otherwise manipulated.

An optical signal 102 may be received at the lens system 104. The optical signal 102 may include a plurality of beams, such as a plurality of rays of light. In some embodiments, the optical signal 102 may be an image, a bundle of rays, a video stream or an optical scene.

In some embodiments, the lens system 104 may receive the optical signal 102 and may provide correcting or focusing of the optical signal 102. For example, the first lens 104 may be an achromatic lens or achromat and can be configured to limit the effects of chromatic and spherical aberration. In some embodiments, the first lens 104 may reduce or focus the optical signal for transmission through the OPA 106. Thus, a change to the optical signal 102 performed by the first lens 104 may be based at least on the properties of the OPA 106.

In an embodiment, the lens system 104 may transmit the optical signal 102 to the OPA 106. In other embodiments, the encryption system 100 may not include the lens system 104 and the optical signal 102 may be initially received by the OPA 106.

The OPA 106 may receive the optical signal 102 in a first arrangement. The first arrangement may refer to the optical signal 102 in its original form, prior to an encryption process. The OPA 106 can be configured to encrypt the optical signal 102 by phase shifting the plurality of beams (e.g., applying a linear phase ramp, performing beam steering) from the first arrangement to a second arrangement that is different from the first. The second arrangement may refer to the optical signal 102 in an encrypted format, thus different from the first arrangement (original format).

In some embodiments, the OPA 106 may divide the optical signal 102 in the first arrangement into a plurality of portions and phase shift and/or steer the plurality of portions to different positions to generate the second arrangement. The OPA 106 may provide or include a series of electronically addressable elements, each of which can be directly controlled to provide a programmable phase shift that is imposed on a beam (or plurality of beams) passing through the OPA 106. For example, by applying a linear phase gradient across a full aperture of the OPA 106, a beam input into the OPA 106 can be steered. In some embodiments, by applying different linear phase ramps across different portions of the OPA 106 aperture, different segments of the input beam can be steered in different directions. It should be appreciated, however that the encryption system 100 is not limited to linear phase shifts and other methods of modifying the optical signal 102 to perform encryption may be used. For example, in some embodiments, the encryption system 100 may use a phase profile to encrypt the optical signal 102.

In some embodiments, the phase shifting and/or beam steering may be performed based on encryption codes. The OPA 106 may control or modify a phase property of at least one of the plurality of beams based on the encryption codes in order to encrypt the optical signal 102. The OPA 106 can be coupled to a steering code module 120 to receive the encryption codes, as will be discussed in greater detail below.

The OPA 106 may transmit the plurality of beams in the second arrangement to the sensor 112. The OPA 106 may phase shift the beams such that they are received at the sensor 112 in a different arrangement than the beams were received at the OPA 106. In an embodiment, the optical signal 102 received at the sensor 112 may appear to be a different image from the optical signal 112 received at the OPA 106.

In some embodiments, sensor 112 may be an image sensor, a video sensor or a camera sensor. Sensor 112 may include a focal plane array 108 and an image module 110. The focal plane array 108 may receive (i.e., sense) the plurality of beams in the second arrangement from the OPA 106. In an embodiment, the focal plane array 108 may be an image sensing device having an array of light-sensing pixels at a focal plane of a lens of the sensor 112. The focal plane array 108 may detect properties of the optical signal 102 in the second arrangement and transmit them to the image module 110. The properties may include, but not limited to, wavelength properties of one or more of the plurality of beams and/or a number of photons in the optical signal 102 detected at each pixel of the focal plane array 108.

Image module 110 may receive the properties of the optical signal 102 in the second arrangement and generate an encrypted optical signal 124. The encrypted optical signal 124 may be an image corresponding to the optical signal 102 in the second arrangement. In some embodiments, the image module 110 may generate an electrical charge, voltage, or resistance in relation to the received properties (e.g., the number of photons detected at each pixel). The charge, voltage, or resistance may be measured, digitized, and used to construct the image (e.g., digital encrypted image) of the optical signal 102 in the second arrangement.

In an embodiment, the steering code module 120 may provide an encryption code to the OPA 106. In other embodiments, the steering code module 120 may be configured to control the beam steering performed by the OPA 106 using the encryption code. For example, the steering code module 120 may control or drive surface elements (e.g., sensing elements) of the OPA 106 to change properties of one or more of the plurality of beams in the optical signal 102.

In some embodiments, a time sequence or time property may be applied to the encryption codes by the steering code module 120. For example, a clock signal may be used to apply the time sequence or time property to the encryption code to generate a time synchronized encryption code. The time sequence or time property may be used as a reference point during an encryption process, decryption process or both.

In some embodiments, the steering code module 120 may include an encryption code generator system to generate the encryption codes. In other embodiments, the steering code module 120 may be coupled to an encryption code generator system to receive the encryption codes. For example, the encryption code generator may be remotely located from the steering code module 120 but communicatively coupled to the steering code module 120. The encryption codes may be pre-populated in the steering code module 120 or alternatively, the encryption codes may be generated in real-time by the steering code module 120. In some embodiments, the encryption codes may be generated or received at the steering code module 120 in periodic time periods, such as regular or fixed intervals. In other embodiments, the encryption codes may be generated in an as needed or random fashion.

It should be appreciated that many different types of encryption codes and encryption code generating techniques may be used herein. In some embodiment, the steering code module may include an RSA device to generate encryption and/or authentication codes.

Figure 1A:
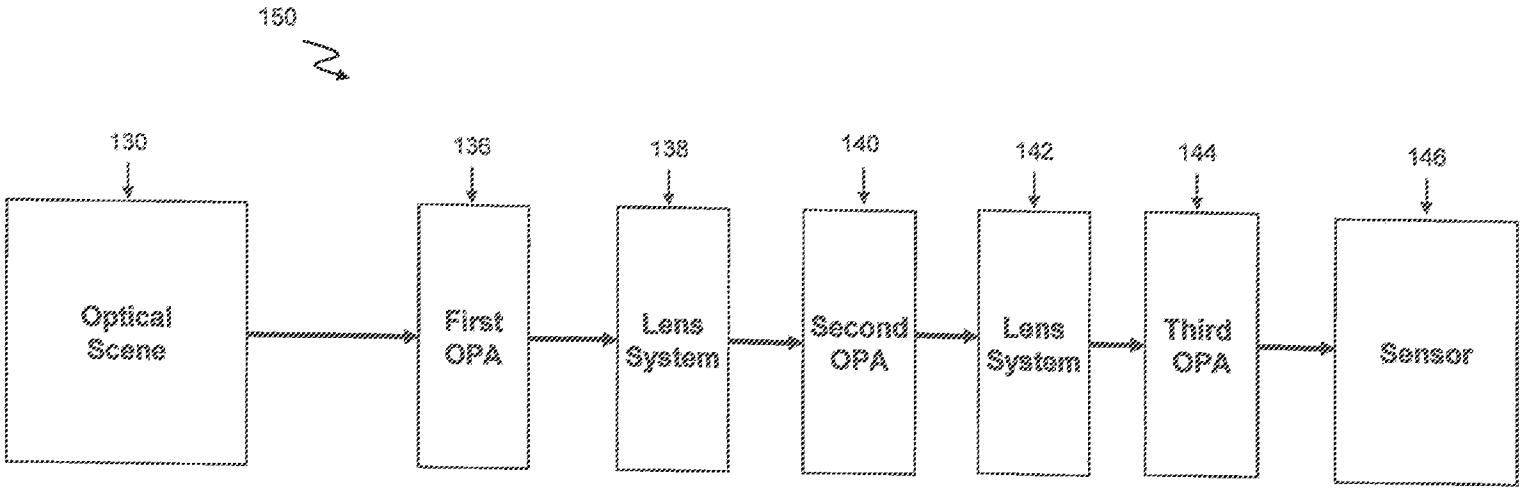
FIG. 1A is a block diagram of an arrangement of OPA devices in an encryption system.

In an embodiment, OPA 106 may be positioned at different positions in an optical signal path to encrypt optical signals prior to the signals being received at a sensor. For example, and now referring to FIG. 1A, an encryption system 150 is provided to illustrate different positions an OPA may be disposed to encrypt optical signals and/or communications. The encryption system 150 includes an optical scene 130, a first OPA 136, a first lens system 138, a second OPA 140, a second lens system 142, a third OPA 144 and a sensor 146. The optical scene 130 may the same or substantially similar to the optical signal 102 of FIG. 1, the first lens system 138 and second lens system 142 may be the same or substantially similar to the lens system 104 of FIG. 1, the first, second and third OPA 136, 140, 144 may be the same or substantially similar to the OPA 106 of FIG. 1 and the sensor 146 may be the same or substantially similar to the sensor 112 of FIG. 1.

In an embodiment, the optical scene 130 may be an area being viewed or a visual scene being viewed by the encryption system 150. For example, in one embodiment, an optical scene 130 may include a person and/or landscape being imaged. In other embodiments, an optical scene 130 may include a person or landscape being recorded (e.g., video surveillance). In some embodiments, the optical scene 130 may be an optical signal, similar to optical signal 102 described above with respect to FIG. 1.

In an embodiment, an OPA (first OPA) 136 may be provided before a first lens system 138. Thus, the first OPA 136 may receive the optical scene 130 initially. In other embodiments, an OPA (second OPA 140) may be provided after the first lens system 138. Thus, the first lens system 138 may receive the optical scene 130 initially. In still other embodiments, an OPA (third OPA 140) be provided after the first lens system 138 and second lens system 142. Thus, the first lens system 138 and second lens system 142 may receive the optical scene 130 before the third OPA 140.

In some embodiments, the encryption system 150 may include one OPA. For example, the encryption system 150 may include one of the first OPA 136, second OPA 140 and third OPA 144. In other embodiments, more than one OPA may be used to encrypt the optical signal 102. For example, the encryption system 150 may include each of the first OPA 136, second OPA 140 and third OPA 144. In some embodiments, the encryption system 150 may include at least two of the first OPA 136, second OPA 140 and third OPA 144. The position and number of OPAs used in an encryption system may selected based on the desired amount of encryption, the properties of the encryption system and/or an environment the encryption system is disposed within.

Figures 1B, 1C, 1D:
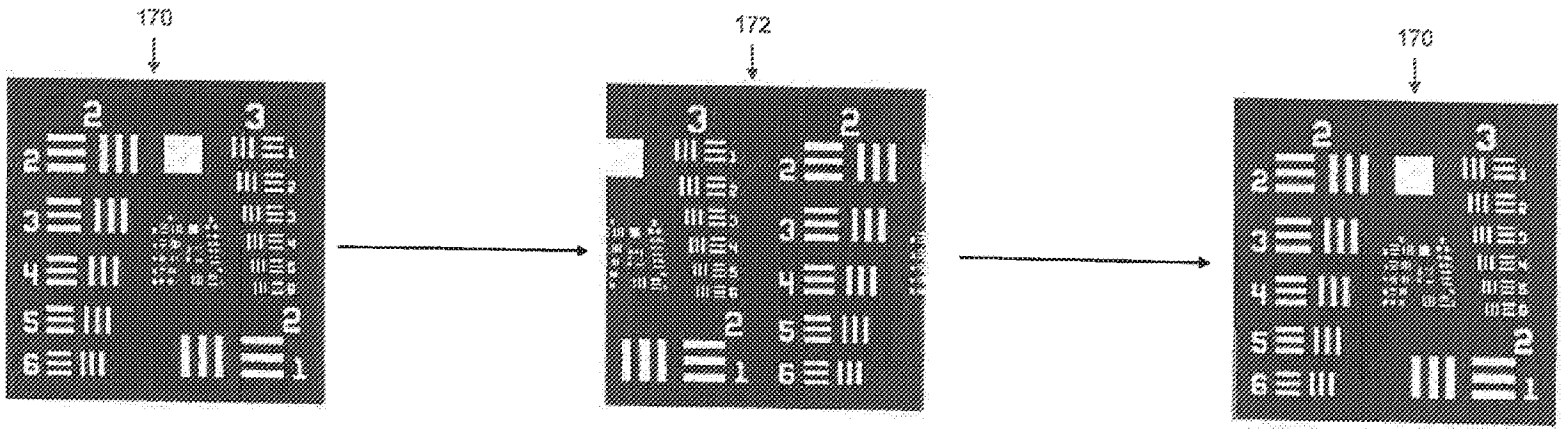
FIG. 1B is an illustration of an image in a first arrangement.
FIG. 1C is an illustration of the image of FIG. 1B after an encryption process and in an encrypted second arrangement.
FIG. 1D is an illustration of the image of FIG. 1C after a decryption process and in the first arrangement.

Now referring to FIGS. 1B-1D, illustrations of an optical signal (shown here as an image) in a first arrangement 170 and a second arrangement 172 are provided. For example, in FIG. 1B, an optical signal may be provided in a first arrangement 170. The first arrangement may correspond to the optical signal when it is received at an OPA initially and prior to any encryption. FIG. 1C illustrates the optical signal after encryption and in the second arrangement 172. As shown in FIG. 1C, the optical signal has been encrypted to change the appearance of the image from how it appeared in the first arrangement 170. FIG. 1D illustrates the optical signal after decryption and in the first arrangement 170. As shown in FIG. 1D, the optical signal has been decrypted to return the appearance of the image back to its original form of FIG. 1B.

In the illustrative embodiments of FIGS. 1B-1D, the image has been divided into a first and second portion (e.g., divided in half) to encrypt the image and then divided into a first and second portion (e.g., divided in half) to decrypt the image back to its original form. For example, an OPA may divide the image into a plurality of portions and phase shift and/or steer portions representing a first half of the image to positions corresponding to a second half of the image and the OPA may phase shift and/or steer portions representing the second half to positions corresponding to the first half of the image.

It should be appreciated that a phase shift or beam steering (e.g., steering) as used and referred to herein may refer to any form of applying a phase shift or phase shift pattern to an OPA in order to modify or otherwise encrypt an optical signal. For example, and without limitation, a phase shift or steering a beam may refer to applying a linear phase ramp, applying a linear phase gradient, using a phase profile or performing beam steering to encrypt an optical signal.

In an embodiment, applying the phase shift may cause the OPA to steer the first portion to the position of the second portion in the first arrangement 170 and steer the second portion to the position of the first portion in the first arrangement 170 to generate the second arrangement 172. The two portions have changed positions to generate a new encrypted image. In this illustrative embodiment, the image appears to be a real image in the second arrangement. Thus, someone attempting to hack or otherwise steal the optical signal may not recognize the image has been encrypted from its original form.

In an embodiment, to decrypt the image, an OPA can phase shift (e.g., steer) the first portion to back to the its position in the first arrangement 170 and phase shift (e.g., steer) the second portion back to its position in the first arrangement 170 to generate the first arrangement 170.

Figure 2:
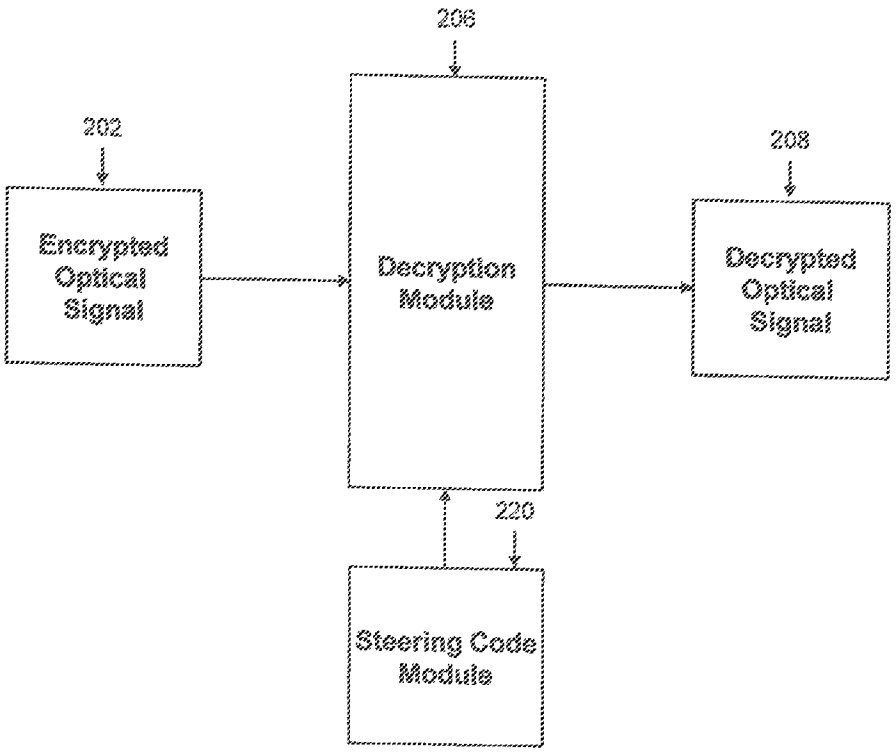
FIG. 2 is a block diagram of a system for decrypting optical signals.

Now referring to FIG. 2, a decryption system 200 includes a decryption module 206 and a steering code module 220. The decryption module 206 may receive an encrypted optical signal 202. The encrypted optical signal 202 may be an encrypted image or encrypted video stream.

In some embodiments, the decryption module 206 may be provided as a component of a remote station to decrypt the encrypted optical signal 202. The remote station may be part of a command post or other manned station that is remotely located from a sensor (e.g., sensor 112 of FIG. 1) to receive sensitive information from the sensor, for example, as part of a video surveillance system. Thus, the decryption module 206 may perform decryption at the remote station and after the transmission of the encrypted optical signal 202. The decryption module 206 may receive the encrypted optical signal 202 in the second arrangement and convert the encrypted optical signal 202 from the second arrangement back to a first arrangement corresponding to an original form of the optical signal.

In some embodiment, decryption module 206 may be independent from the remote station 230 and disposed in a signal path between a sensor and the remote station 230 and the decryption module 206 may perform decryption to transmit a decrypted optical signal 208 to the remote station.

In other embodiments, decryption module 206 may be independent from the remote station 230 and not be disposed in a signal path between the sensor 212 and the remote station 230. Instead, the remote station 230 may first receive the encrypted optical signal 202 and then transfer the encrypted optical signal 202 to the decryption module 206 for decryption. The decryption module 206 may perform decryption methods as described herein and transmit a decrypted optical signal back to the remote station 230.

The decryption module 206 may be coupled to the steering code module 220. In an embodiment, the steering code module 220 may the same or substantially similar to the steering code module 120 described above with respect to FIG. 1.

The decryption module 206 may receive decryption codes from steering code module 220. In an embodiment, the decryption codes may correspond to or mirror encryption codes used by an OPA (such as OPA 106 of FIG. 1) to encrypt the optical signal 202.

In some embodiments, the decryption codes may include a time sequence or time property that may be used as a reference point during an encryption process, decryption process or both. The time sequence or time property may be applied to the decryption codes by the steering code module 220. For example, a clock signal may be used to apply the time sequence or time property to the decryption codes to generate a time synchronized decryption codes. The The decryption module 206 may decrypt the encrypted optical signal 202 using analog methods, digital methods or optical methods. For example, the decryption module 206 may generate a model (i.e., software representation) of a lens system and OPA system (e.g., lens system 104, OPA 106 of FIG. 1) used in an encryption process to digitally decrypt the encrypted optical signal 202 and generate a decrypted optical signal 208. For example, the model may be a software representation of the hardware used to encrypt the optical signal. In an embodiment, the decryption module 206 may use the model to identify the properties and differences between the encrypted optical signal 202 and its original form (prior to encryption). The decryption module 206 may reconstruct the original optical signal using the model and the identified properties and differences to generate the decrypted optical signal 208. The decryption methods will be described in greater detail with respect to FIG. 4.

In other embodiments, the decryption module 206 may include an OPA to optically decrypt the encrypted optical signal 202. For example, and referring to FIG. 3, decryption module may include an OPA 316. The sensor 312, focal plane array 308, image module 310, and steering code module 320 may be the same or substantially similar to the sensor 112, focal plane array 108, image module 110, and steering code module 120, respectively, described above with respect to FIG. 1.

In an embodiment, OPA 316 may receive the encrypted optical signal 302 in the second arrangement (i.e., encrypted) and convert the plurality of beams in the encrypted optical signal 302 to a first arrangement. In some embodiments, the encrypted optical signal 302 may be received by a lens system 304 before the OPA 316. The lens system 304 may be the same or substantially similar to the lens system 104 described above with respect to FIG. 1. The lens system 304 may receive the encrypted optical signal 302 and may provide correcting or focusing before providing the encrypted optical signal 302 to the OPA 316.

In an embodiment, the first arrangement may be the original arrangement of the plurality of beams prior to the application of any encryption techniques. In some embodiments, OPA 316 may phase shift the plurality of beams in the optical signal 302 from the second arrangement to the first arrangement.

In an embodiment, the OPA 316 may be coupled to the steering code module 320. The OPA 316 may receive decryption codes from the steering code module 320 to convert the optical signal 302 from the second arrangement to the first arrangement.

In some embodiments, the steering code module 320 may provide the decryption code to the OPA 316. The decryption codes may correspond to the encryption codes received by OPA 106 of FIG. 1 to encrypt the optical signal 102. In other embodiments, the steering code module 320 may be configured to control the beam steering performed by the OPA 316 using the decryption code. For example, the steering code module 320 may control or drive surface elements of the OPA 316 to change properties of one or more of the plurality of beams in the encrypted optical signal 302.

In some embodiments, the encrypted optical signal 302 may be an image and OPA 316 may divide the image into a plurality of portions. OPA 316 may phase shift one or more of the portions to convert the image from the second arrangement to the first arrangement. For example, in one embodiment, OPA 316 may divide the encrypted optical signal 302 into a first portion and a second portion. OPA 316 may the phase shift to the first portion to the position or location where the second portion was previously and phase shift to the second portion to the position or location where the first portion was previously (e.g., swap the positions of the first portion and the second portion) to convert the image from the second arrangement to the first arrangement.

In an embodiment, the plurality of beams in the encrypted optical signal 302 may be phase shift (e.g., steered) to the focal place array 308 in the first arrangement. The focal plane array 308 may receive (i.e., sense) the plurality of beams in the first arrangement from the OPA 316. In an embodiment, the focal plane array 308 may be an image sensing device having an array of light-sensing pixels at a focal plane of a lens of the sensor 312. The focal plane array 308 may detect properties of the decrypted optical signal 322 in the first arrangement and transmit them to the image module 310. The properties may include, but not limited to, wavelength properties of one or more of the plurality of beams and/or a number of photons in the decrypted optical signal 322 detected at each pixel of the focal plane array 308.

Image module 310 may receive the properties of the decrypted optical signal 322 in the first arrangement and generate the decrypted optical signal 322. The decrypted optical signal 322 may be an image corresponding to the original optical signal received prior to encryption. In some embodiments, the image module 310 may generate an electrical charge, voltage, or resistance in relation to the received properties (e.g., the number of photons detected at each pixel). The charge, voltage, or resistance may be measured, digitized, and used to construct the image (e.g., digital encrypted image) of the decrypted optical signal 322 in the first arrangement.

Figure 4:
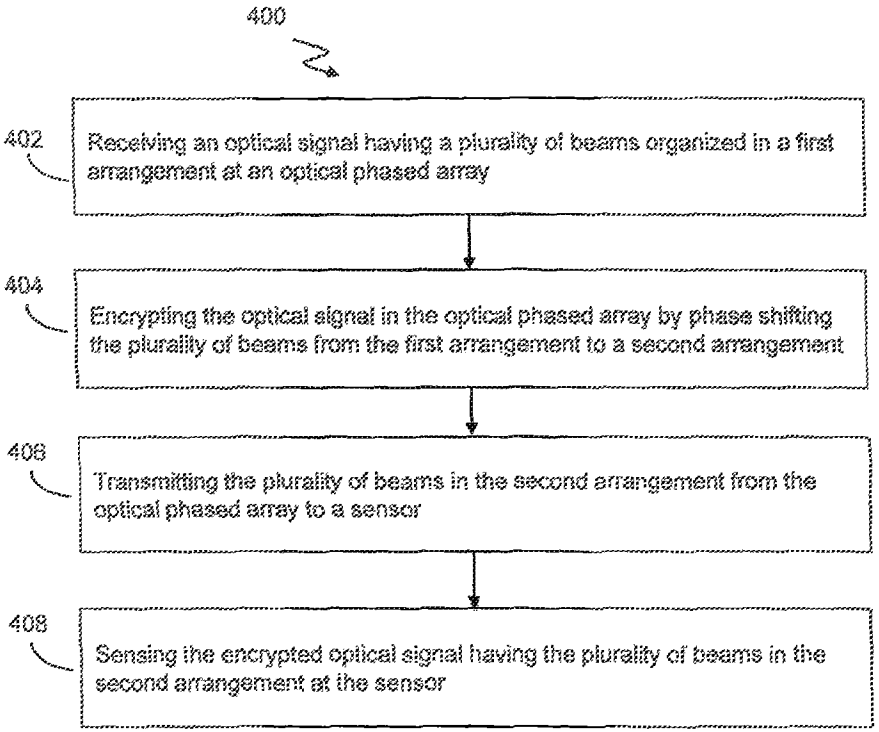
FIG. 4 is a flow diagram of a method for encrypting optical signals.

Now referring to FIG. 4, a flow diagram of a method 400 for encrypting optical signals includes receiving an optical signal having a plurality of beams organized in a first arrangement at an optical phased array, encrypting the optical signal in the optical phased array by phase shifting the plurality of beams from the first arrangement to a second arrangement, transmitting the plurality of beams in the second arrangement from the optical phased array to a sensor and sensing the encrypted optical signal having the plurality of beams in the second arrangement at the sensor.

At block 402, an optical signal having a plurality of beams organized in a first arrangement may be received at an optical phased array. In an embodiment, the OPA may be disposed in an optical path between a lens system and a focal plane array (FPA) of a sensor to scramble (i.e., encrypt) an optical signal being sensed. The optical signal may include video information (e.g., analog or digital). For example, in one embodiment, the optical signal may be an image, video stream or optical scene. The optical signal may include a plurality of beams (e.g., rays of light) that can be organized in a first arrangement. The first arrangement may correspond to an original form (e.g., original image).

At block 404, the optical signal may be encrypted in the OPA by steering or otherwise phase shifting the plurality of beams from the first arrangement to a second arrangement. In an embodiment, the OPA may steer or otherwise phase shift the plurality of beams of the optical signal to the sensor in a different arrangement then they were received at the OPA, thus encrypting the optical signal. For example, the OPA may include a plurality of sensing elements that can be controlled to steer or otherwise phase shift the plurality of beams. In some embodiments, the plurality of beams sensed at the sensor appear to be scrambled in a random pattern. The OPA may steer or otherwise phase shift the plurality of beams at the focal plane array of a sensor in such a way to generate the second arrangement.

In some embodiments, a steering code may transmit an encryption signal to the OPA. The encryption signal may be generated by the steering code module or an encryption code generated and include encryption codes and/or instructions on how to steer or otherwise phase shift the plurality of beams to encrypt the optical signal and generate the second arrangement. For example, in some simpler embodiments, the encryption signal may indicate how to divide the optical signal into a plurality of portions, how many portions to generate and how to re-arrange the portions to generate the second arrangement. The encryption signal may indicate a phase shift value to apply to one or more of the plurality of beams in the optical signal.

In some embodiments, the steering code module may apply a time sequence or time period to the encryption codes. The time sequence or time period may be used a reference point in either an encryption process and/or decryption process.

The steering code module may generate or receive a time synchronized encryption signal and use it to control the components (e.g., sensing elements) of the OPA to steer the plurality of beams and encrypt the optical signal. In other embodiments, the steering code module may transmit the time synchronized encryption signal to the OPA.

At block 406, the plurality of beams may be transmitted in the second arrangement from the optical phased array to a sensor. In an embodiment, the plurality of beams in the beams in the optical signal may be transmitted from the OPA to the sensor (e.g., FPA) in the second arrangement. The second arrangement may be different from the first arrangement.

In some embodiments, the OPA may divide the optical signal into a plurality of portions in the first arrangement and steer or otherwise phase shift the plurality of portions to the sensor in the second arrangement. For example, in an embodiment in which the optical signal is an image, the OPA may divide the first image into a plurality of portions in the first arrangement and steer or otherwise phase shift the plurality of portions to the sensor in the second arrangement to generate a second image. In one embodiment, the OPA may divide the optical signal into a first portion and a second portion and steer or otherwise phase shift the plurality of beams in the first portion to the second portion and steering or otherwise phase shifting the plurality of beams in the second portion to the first portion to generate the second arrangement.

In an embodiment, a phase shift may be applied to one or more of the plurality of beams in the optical signal. The phase shift may be used to steer or otherwise phase shift one or more of the plurality of beams of the optical signal to a different position than the respective beam was positioned in the first arrangement. Thus, in the second arrangement, the respective beam may appear shifted with respect to its position in the first arrangement. The amount of the phase shift may vary from beam to beam in the optical signal. In some embodiments, beams may be grouped together and each beam in a respective group may receive the same phase shift. For example, a first phase shift may be applied to a first group of beams and a second phase shift may be applied to a second group of beams. It should be appreciated however that the number of groups and/or different phase shifts applied to an optical signal may vary depending on the encryption signal.

At block 408, the encrypted optical signal may be sensed having the plurality of beams in the second arrangement at the sensor. The optical signal may be received at the sensor in the second arrangement. In some embodiments, the second arrangement may be a random pattern. In other embodiments, the second arrangement may be a new image.

The encrypted optical signal may be transmitted to a remote station. In an embodiment, the remote station may be a command post or manned station that is remotely located from the sensor. The encrypted optical signal may be transmitted with the plurality of beams in the second arrangement or an arrangement that is different from how the beams were received initially at the OPA and prior to encryption.

In some embodiments, the encrypted optical signal may be decrypted at the remote station. The remote station may include or be communicatively coupled to a decryption module to receive the encrypted optical signal and decrypt the optical signal by converting the plurality of beams from the second arrangement to the first arrangement or otherwise back to an original arrangement prior to any encryption process. The encrypted optical signal may be decrypted using optical or digital techniques.

For example, in some embodiments, the encrypted optical signal may be decrypted using an OPA. The OPA may be a component of the decryption module. The OPA may operate in the same or substantially the same manner as the OPA used to encrypt the optical signal, however the OPA at the decryption module may decrypt the optical signal using a decryption signal. The decryption signal may be received from an image module and/or steering module. For example, the decryption signal may be generated by steering code module or decryption code generator and include decryption codes and/or instructions on how to steer or otherwise phase shift the plurality of beams to decrypt the optical signal and convert the optical signal from the second arrangement to the first arrangement. For example, in some embodiments, the decryption signal may indicate how to divide the optical signal into a plurality of portions, how many portions and how to re-arrange the portions to convert the optical signal from the second arrangement to the first arrangement. The decryption signal may indicate a phase shift value to apply to one or more of the plurality of beams in the optical signal. In an embodiment, the decryption signal may correspond to the encryption signal used to encrypt the optical signal.

In some embodiments, the encrypted optical signal may be an image and the OPA may divide the image into a plurality of portions. The OPA may steer or otherwise phase shift one or more of the portions to convert the image from the second arrangement to the first arrangement. For example, in one embodiment, the OPA may divide the optical signal into a first portion and a second portion. The OPA may then steer the first portion to the position or location where the second portion was previously and steer the second portion to the position or location where the first portion was previously (e.g., swap the positions of the first portion and the second portion) to convert the image from the second arrangement to the first arrangement.

In an embodiment, a phase shift may be applied to one or more of the plurality of beams in the optical signal to convert the image from the second arrangement to the first arrangement. The phase shift may refer to applying a linear phase ramp, applying a linear phase gradient, using a phase profile or performing beam steering to decrypt the optical signal. The decryption signal may indicate the degree of phase shift for one or more of the plurality of beams. For example, the OPA may use the decryption signal to steer one or more of the plurality of beams of the encrypted optical signal to a different position than the respective beam was positioned in the second arrangement and produce an optical signal that is the same or substantially the same as the original optical signal prior to encryption.

The amount of the phase shift may vary from beam to beam in the optical signal. In some embodiments, beams may be grouped together and each beam in a respective group may receive the same phase shift. For example, a first phase shift may be applied to a first group of beams and a second phase shift may be applied to a second group of beams. It should be appreciated however that the number of groups and/or different phase shifts applied to an optical signal may vary depending on the decryption signal.

In some embodiments, the OPA may be coupled to the steering code module. The steering code module may control beam steering properties of the OPA using the decryption signal. For example, the steering code module may control sensing elements of the OPA to steer one or more of the plurality of beams in optical signal to convert the optical signal from the second arrangement to the first arrangement. In some embodiments, the steering code module may control the OPA to apply a phase shift to one or more of the plurality of beams in the optical signal to convert the optical signal from the second arrangement to the first arrangement.

In some embodiments, the steering code module may apply a time sequence or time period to the decryption signals. The time sequence or time period may be used as a reference point in either an encryption process and/or decryption process. The steering code module may generate or receive a time synchronized decryption signal and use it to control the components (e.g., sensing elements) of the OPA to steer the plurality of beams and decrypt the optical signal. In other embodiments, the steering code module may transmit the time synchronized decryption signal to the OPA.

In some embodiments, the steering code module may provide the decryption signal to the OPA. In other embodiments, the steering code module may be configured to control the beam steering performed by the OPA using the decryption signal. For example, the steering code module may control or drive surface elements of the OPA to change properties of one or more of the plurality of beams in the optical signal to convert the optical signal from the second arrangement to the first arrangement.

In an embodiment, the encrypted optical signal may be decrypted using digital techniques. The decryption module may generate a representative model of an OPA encryption function used to encrypt the optical signal. For example, the decryption module 206 may generate a model (i.e., software representation) of a lens system and OPA system (e.g., lens system 104, OPA 106 of FIG. 1) used in an encryption process to digitally decrypt an encrypted optical signal. The model may be a software representation of the hardware used to encrypt the optical signal. The decryption module may use the model to identify the properties and differences between the encrypted optical signal and its original form (prior to encryption).

The decryption module may reconstruct the original optical signal using the model and the identified properties and differences to generate the decrypted optical signal 208. For example, the encrypted optical signal may be divided into a plurality of regions. An array of angles may be applied to each region. In some embodiments, the number of angles may correspond to the number of regions generated. For example, in one embodiment, the encrypted optical signal may be divided into 256 vertical regions and an array of 256 angles may be applied. In an embodiment, each of the regions can be separately controlled. For example, one embodiment, each region may receive a different angle or phase shift (e.g., one angle or phase shift per region). In other embodiments, one or more regions may receive a different angle or phase shift. It should be appreciated however that any type of angular orientation may be used to divide the encrypted optical signal into regions and not just vertical regions or horizontal regions.

An offset value may be determined for each of the regions. The offset value may correspond to a difference of a position of the respective region in the second arrangement compared to the first arrangement. In some embodiments, an angle and a distance from the OPA to lens portion of the sensor, as well as the pixel pitch of the OPA may be used to determine the offset value.

In an embodiment, the optical signal may be reconstructed by positioning each of the regions based on the determined offset value. Region by region, the optical signal may be decrypted by reconstructing the optical signal back to the first arrangement or original arrangement prior to encryption. In some embodiments, when more complex phase shifts are employed in the encryption of the optical signal, the decryption process may include reversing the effect of the implemented phase shifts.

Figure 5:
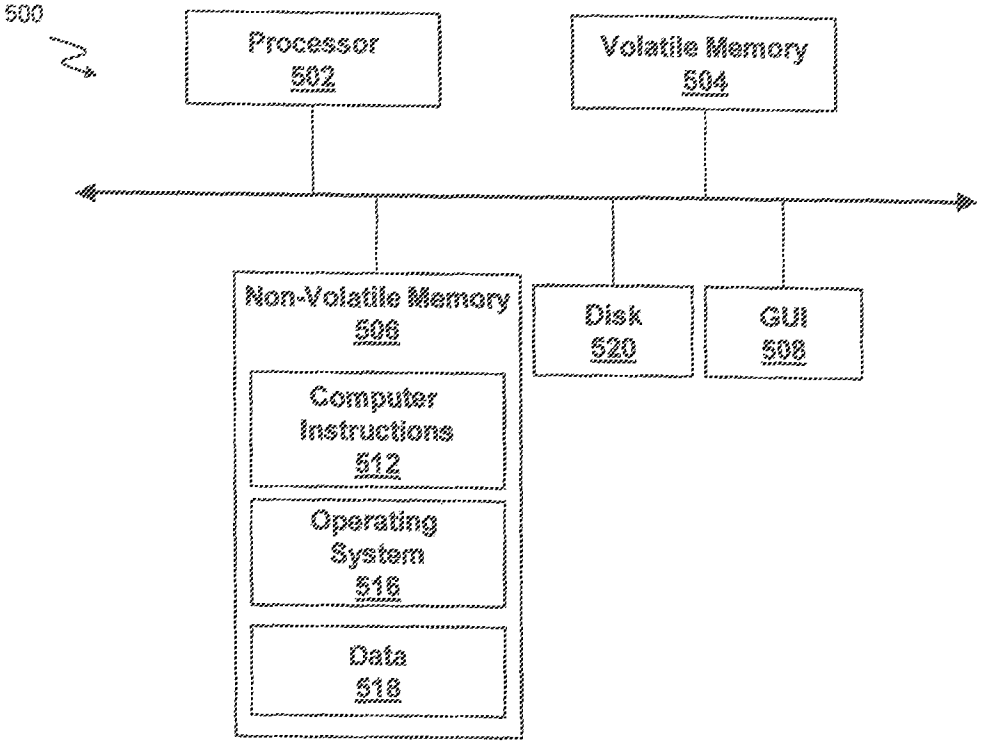
FIG. 5 is a block diagram of an embodiment of a computer system.

Referring to now FIG. 5, a computer 500 includes a processor 502, a volatile memory 504, a non-volatile memory 506 (e.g., hard disk), a graphical user interface (GUI) 508 (e.g., a mouse, a keyboard, a display, for example) and a computer disk 520. The non-volatile memory 506 stores computer instructions 512, an operating system 516 and data 518. In an embodiment, the data 518 may be delivered in various forms of optical signals and/or communications, including but not limited to, an image or a plurality of rays of light. In some embodiments, non-volatile memory 506 includes a look-up table that stores and organizes data corresponding to the optical signals and/or communications and various encryption code generation techniques. In one example, the computer instructions 512 are executed by the processor 502 out of volatile memory 504 to perform all or part of the method (or process) 400 of FIG. 4.

Figure 3:
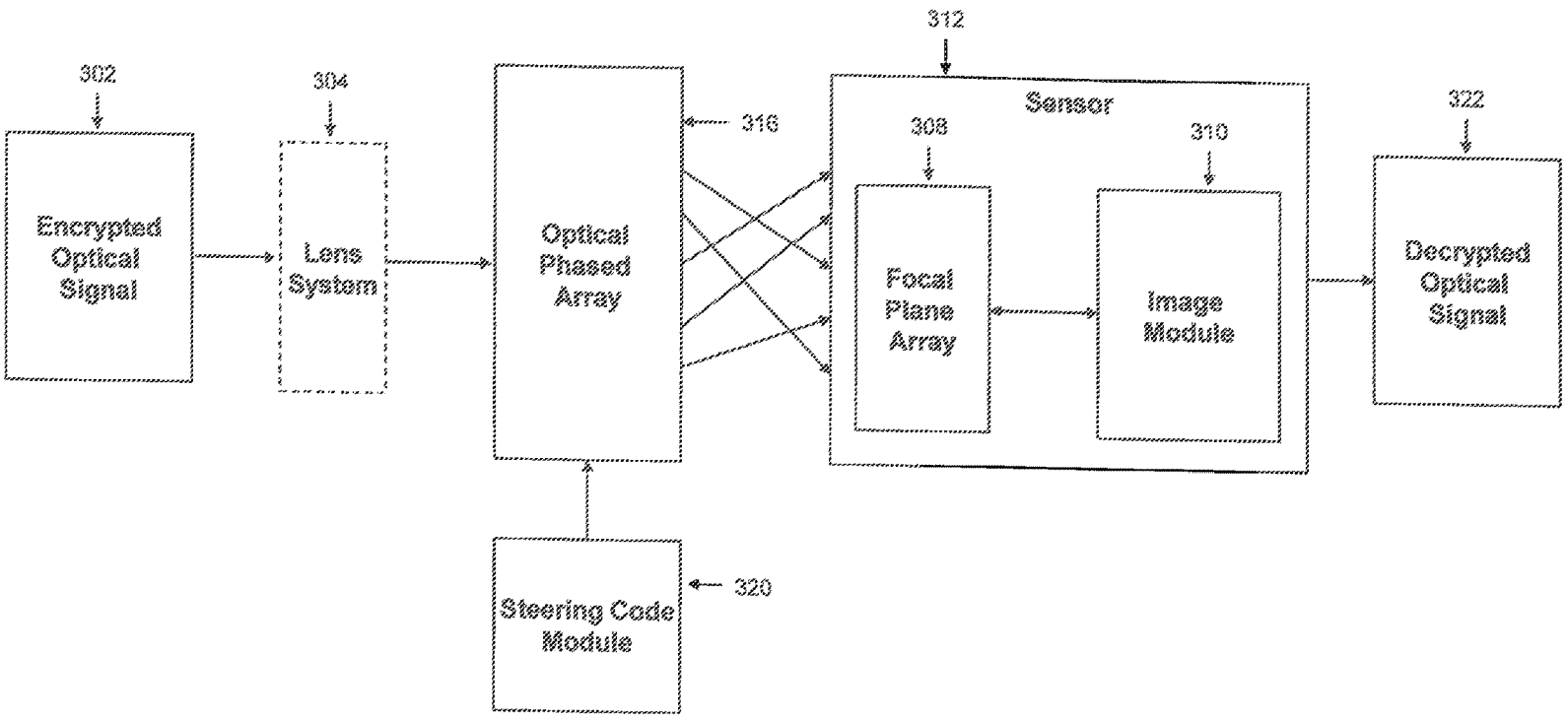
FIG. 3 is a block diagram of a system for decrypting optical signals using an OPA.

In an embodiment, computer 500 may be the same as or substantially similar to each of the sensor 112, image module 110, and steering code module 120 of FIG. 1, steering code module 220 and decryption module 206 of FIG. 2, and the sensor 312, image module 310, steering code module 320 and decryption module 306 of FIG. 3. Computer 500 may perform all of the same functions and be configured to receive and generate the same data as each of the sensor 112, image module 110, and steering code module 120 of FIG. 1, steering code module 220 and decryption module 206 of FIG. 2, and the sensor 312, image module 310, steering code module 320 and decryption module 306 of FIG. 3. For example, computer 500 may be configured to generate encryption codes and control the phase shifting of an OPA to optically encrypt an image.

Method 400 is not limited to use with the hardware and software of FIG. 5; they may find applicability in any computing or processing environment and with any type of machine or set of machines that is capable of running a computer program. Method 400 may be implemented in hardware, software, or a combination of the two. Method 400 may be implemented in computer programs executed on programmable computers/machines that each includes a processor, a storage medium or other article of manufacture that is readable by the processor (including volatile and non-volatile memory and/or storage elements), at least one input device, and one or more output devices. Program code may be applied to data entered using an input device to perform method 400 and to generate output information.

The system may be implemented, at least in part, via a computer program product, (e.g., in a machine-readable storage device), for execution by, or to control the operation of, data processing apparatus (e.g., a programmable processor, a computer, or multiple computers)). Each such program may be implemented in a high level procedural or object-oriented programming language to communicate with a computer system. However, the programs may be implemented in assembly or machine language. The language may be a compiled or an interpreted language and it may be deployed in any form, including as a stand-alone program or as a module, component, subroutine, or other unit suitable for use in a computing environment. A computer program may be deployed to be executed on one computer or on multiple computers at one site or distributed across multiple sites and interconnected by a communication network. A computer program may be stored on a storage medium or device (e.g., CD-ROM, hard disk, or magnetic diskette) that is readable by a general or special purpose programmable computer for configuring and operating the computer when the storage medium or device is read by the computer to perform method 400. Method 400 may also be implemented as a machine-readable storage medium, configured with a computer program, where upon execution, instructions in the computer program cause the computer to operate in accordance with method 400.

Method 400 may be performed by one or more programmable processors executing one or more computer programs to perform the functions of the system. All or part of the system may be implemented as, special purpose logic circuitry (e.g., an FPGA (field programmable gate array) and/or an ASIC (application-specific integrated circuit)).

A number of embodiments of the disclosure have been described. Nevertheless, it will be understood that various modifications may be made without departing from the spirit and scope of the disclosure. Elements of different embodiments described herein may be combined to form other embodiments not specifically set forth above. Other embodiments not specifically described herein are also within the scope of the following claims.

What is claimed:

1. A method for encrypting optical signals, the method comprising:

receiving an optical signal having a plurality of beams organized in a first arrangement at an optical phased array having a plurality of surface elements;

encrypting the optical signal in the optical phased array using the plurality of surface elements by phase shifting the plurality of beams from the first arrangement to a second arrangement according to an encryption code, wherein second arrangement is different than the first arrangement and the plurality of surface elements is controllable to change properties of one or more of the plurality of beams;

transmitting the plurality of beams in the second arrangement from the optical phased array to a sensor; and sensing the plurality of beams in the second arrangement at the sensor to generate an output for the encrypted optical signal.

2. The method of claim 1, wherein the optical signal comprises a first image or a video stream.

3. The method of claim 2, furthering comprising:

dividing the first image into a plurality of portions in the first arrangement; and phase shifting the plurality of portions to the sensor in the second arrangement to generate a second image.

4. The method of claim 1, further comprising:

dividing the optical signal into a first portion and a second portion; and phase shifting the plurality of beams in the first portion to the second portion and phase shifting the plurality of beams in the second portion to the first portion to generate the second arrangement.

5. The method of claim 1, wherein encrypting the optical signal further comprises applying a controllable phase shift to one or more of the plurality of beams in the optical signal.

6. The method of claim 1, further comprising applying a first phase shift to a first group of beams in the plurality of beams and applying a second phase shift to a second group of beams in the plurality of beams.

7. The method of claim 1, further comprising decrypting the optical signal to convert the plurality of beams from the second arrangement to the first arrangement.

8. The method of claim 7, further comprising modulating a phase of one or more of the plurality of beams in the second arrangement in a second optical phased array to convert the plurality of beams from the second arrangement to the first arrangement.

9. The method of claim 1, further comprising dividing the optical signal in the second arrangement into a plurality of regions.

10. The method of claim 9, further comprising determining an offset value for each of the plurality of regions, wherein the offset value corresponds to a difference of a position of the respective region in the second arrangement compared to the first arrangement.

11. The method of claim 10, further comprising reconstructing the optical signal in the first arrangement based on the plurality of regions and the offset value corresponding to each region.

12. A system for encrypting optical signals, the system comprising:

a first lens to receive an optical signal having a plurality of beams organized in a first arrangement;

a first optical phased array disposed in an optical path between the first lens and a sensor, wherein the first optical phased array includes a plurality of surface elements, and wherein the first optical phased array is configured to encrypt the optical signal using the plurality of surface elements by phase shifting the plurality of beams from the first arrangement to a second arrangement according to an encryption code, wherein second arrangement is different than the first arrangement and the plurality of surface elements is controllable to change properties of one or more of the plurality of beams; and a sensor to sense the plurality of beams organized in the second arrangement from the first optical phased array to generate an output for the encrypted optical signal.

13. The system of claim 12, further comprising a second lens disposed in the optical path between the first optical phased array and the sensor.

14. The system of claim 12, further comprising a steering code module coupled to the first optical phased array, wherein the steering code module is configured to provide the encryption code to the first optical phased array to phase shift the plurality of beams to the second arrangement.

15. The system of claim 12, wherein the sensor comprises:

a focal plane array to receive the plurality of beams from the first optical phased array; and an image module to process the plurality of beams to generate the output for the encrypted optical signal, and transmit the output for the encrypted optical signal.

16. The system of claim 12, further comprising a decryption module configured to receive the encrypted optical signal from the sensor and convert the plurality of beams from the second arrangement to the first arrangement.

17. The system of claim 16, wherein the decryption module comprises a second optical phase array to modulate a phase of one or more of the plurality of beams in the second arrangement to optically decrypt the optical signal.

18. The system of claim 16, wherein the decryption module is coupled to a steering code module coupled to receive the encryption code provided to the first optical phased array.

19. The system of claim 17, wherein the decryption module is configured to divide the encrypted optical signal in the second arrangement into a plurality of regions.

20. The system of claim 19, wherein the decryption module is configured to:

determine an offset value for each of the plurality of regions, wherein the offset value corresponds to a difference of a position of the respective region in the second arrangement compared to the first arrangement; and reconstruct the optical signal in the first arrangement based on the plurality of regions and the offset value corresponding to each region.

* * * * *